United States Patent [19]

Stobb

[11] 4,413,723

[45] Nov. 8, 1983

[54] METHOD AND APPARATUS FOR CONVEYING A SHEET

[75] Inventor: Walter J. Stobb, Pittstown, N.J.

[73] Assignee: Stobb, Inc., Clinton, N.J.

[21] Appl. No.: 328,209

[22] Filed: Dec. 7, 1981

[51] Int. Cl.[3] ..... B65G 47/24

[52] U.S. Cl. ..... 198/415; 198/374; 474/69

[58] Field of Search ..... 198/374, 415, 817, 835; 474/69

[56] References Cited

U.S. PATENT DOCUMENTS

| | | | |
|---|---|---|---|
| 914,832 | 3/1909 | Hedrain | 193/36 |
| 3,160,259 | 12/1964 | Dalton . | |
| 3,191,747 | 6/1965 | Pollard | 198/367 |
| 3,195,710 | 7/1965 | Robinson | 198/415 X |
| 3,323,425 | 6/1967 | Brockmuller | 93/8 |
| 4,155,440 | 5/1979 | Bogjanski et al. | 198/415 X |

FOREIGN PATENT DOCUMENTS

| | | | |
|---|---|---|---|
| 886752 | 1/1962 | United Kingdom | 474/69 |
| 1239334 | 8/1969 | United Kingdom . | |

*Primary Examiner*—John J. Love
*Assistant Examiner*—Paul A. Sobel
*Attorney, Agent, or Firm*—Arthur J. Hansmann

[57] ABSTRACT

Method and apparatus of conveying a sheet in a turning action to alter its path of movement. The operator has the option of conveying the sheet through a bump turn mode or a flow turn mode. In the bump turn mode, the original sheet leading edge on a first conveyor is not the leading edge on the second conveyor but instead the sheet side edge becomes the leading edge. In the flow turn mode, the operator can drive the conveyor members of the first conveyor so that the sheet is rotated ninety degrees on the first conveyor and is then deposited onto the second conveyor so that the sheet leading edge on the first conveyor is also the leading edge on the second conveyor. The apparatus consists of a first conveyor and a second conveyor with the first conveyor having individually driven members for the optional modes mentioned.

3 Claims, 3 Drawing Figures

METHOD AND APPARATUS FOR CONVEYING A SHEET

This invention relates to a method and apparatus for conveying a sheet in a turning action to alter its path of movement. The invention has particular application in the graphic arts industry, and it will be described in that context and in connection with the conveyance of paper materials of folded or unfolded form.

BACKGROUND OF THE INVENTION

The prior art is already aware of the method and apparatus of conveying a sheet, such as paper in a signature form, for instance, along a conveyor system which either changes the orientation of the sheet from a front-leading edge to a side-leading edge, that is, turns the sheet at a right angle. Also, the prior art is aware of the conveyor system and method whereby sheets are turned in a ninety degree or so arc but the front edge is always the front or leading edge in the path of movement of the sheet. That is, in the first aforesaid example of the prior art, one conveyor leads the sheet in a forward direction and against a stop, where the sheet is intercepted and is then placed onto a second conveyor, which leads the sheet in a sidewise direction so that the sheet then has its side edge become its leading edge. In the aforesaid second example of the prior art, a conveyor with a ninety degree arc is utilized and the sheet simply moves through that ninety degree ard, but its initial leading edge is also its final leading edge while the sheet traverses the ninety degree arc. Those skilled in the graphic arts industry are already familiar with that type of sheet movement and orientation for purposes of presenting a sheet to other apparatus for collating or other functions common in the art. Prior art showings of conveyor systems and methods for transporting a product and governing the leading edge of the product are shown in U.S. Pat. Nos. 914,832 and 3,160,259 and 3,191,747 and 3,323,425 and in British Pat. No. 1,239,334. Those prior art showings differ from the present invention in both the method in apparatus in that the present invention provides a system for controlling the leading edge of a sheet while the sheet is being conveyed along a path, such that either the leading edge remains as the leading edge throughout that conveyance, or the sheet is turned so that its initial front or leading edge is no longer the leading edge but instead the side edge of the sheet becomes the new leading edge. Further, in the prior art method and apparatus, separate apparatus and systems are required for either the side movement of the sheet, as mentioned and described herein, or for the acruate or ninety degree turn movement. In the present invention, only one system or one set of apparatus is required, and either the side movement or the turning movement can be effected, by the operator's choice of using the apparatus or employing the appropriate method of this invention.

Accordingly, the present invention provides a system whereby the system can be operated and a mode for either the so-called bump turn or sidewise sheet movement, or for the ninety degree arcuate turn movement, all at the option of the operator. In accomplishing this objective, only one set of apparatus is required, and it can be placed in either mode of operation by manipulation of parts of the apparatus. In the specific method in apparatus of this invention, a set of conveyor belts is utilized for conveying a sheet, and drive members are related to the individually driven belts so that the belts can move at either the same speed, for the so-called bump turn mode, or the belts can be operated at speeds wherein each belt operates at a different speed, and thus the arcuate flow turn mode is accomplished.

DETAILED DESCRIPTION OF THE PREFERRED METHOD AND APPARATUS

Figure 1:
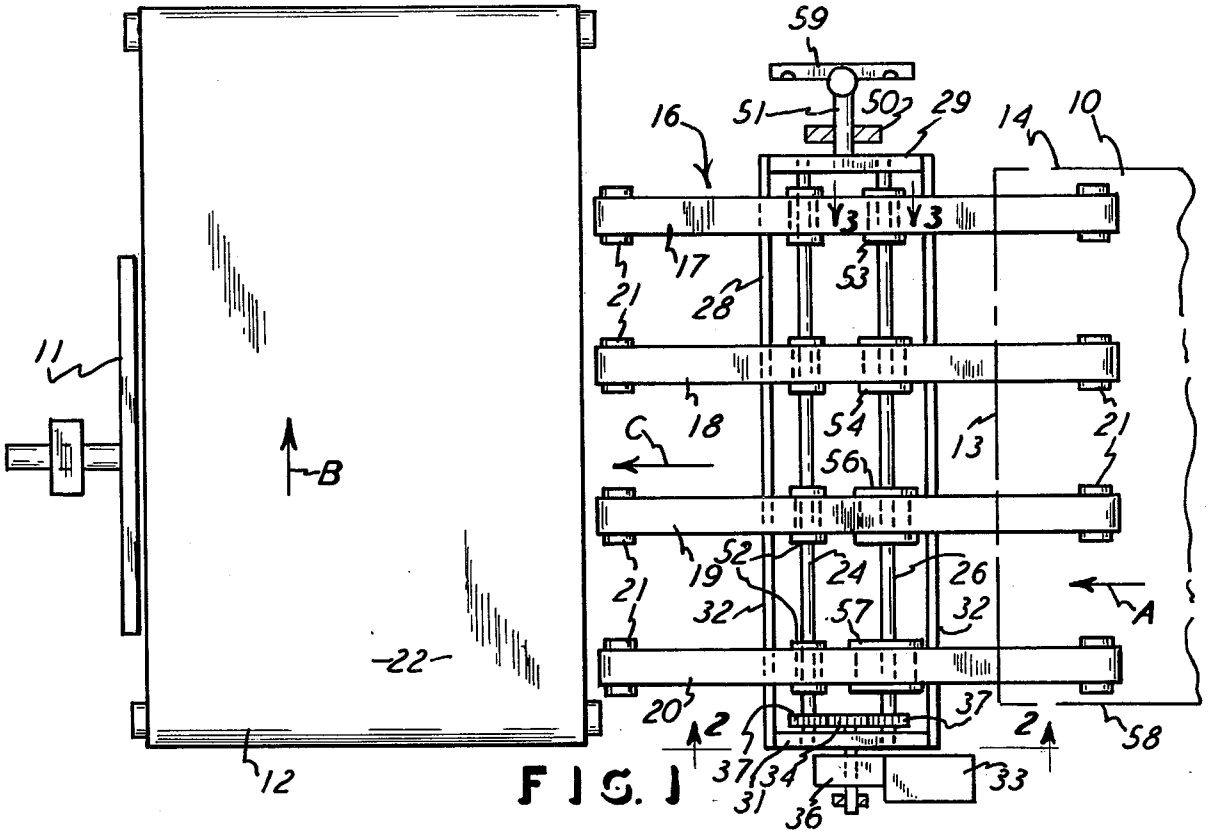
FIG. 1 is a top plan view of apparatus of this invention.

The following description makes reference to the drawing and discloses the apparatus. In doing so, the method is also described and will be understood by one skilled in the art. It will be further understood that the word "sheet" can mean a sheet of paper in either a folded or unfolded form, whatever the desired condition may be.

FIG. 1 shows some of a basic so-called bump turn system wherein a first conveyor transports a sheet 10, shown in fragment and in dot-dash lines and moving in the direction of the arrow A. The sheet 10 is moved straight along the first conveyor and is directed against a conventional stop 11 and is thus deposited onto a second conveyor 12, which has its upper surface operating in the direction of the arrow B. Thus, the sheet leading edge 13 on the first conveyor is no longer the leading edge when the sheet is on the second conveyor 12. Instead, the sheet side edge 14 becomes the leading edge when the sheet 10 is deposited onto the conveyor 12. As mentioned, that is a conventional type of bump turn arrangement which anyone skilled in the art is familiar with and will understand.

Figure 2:
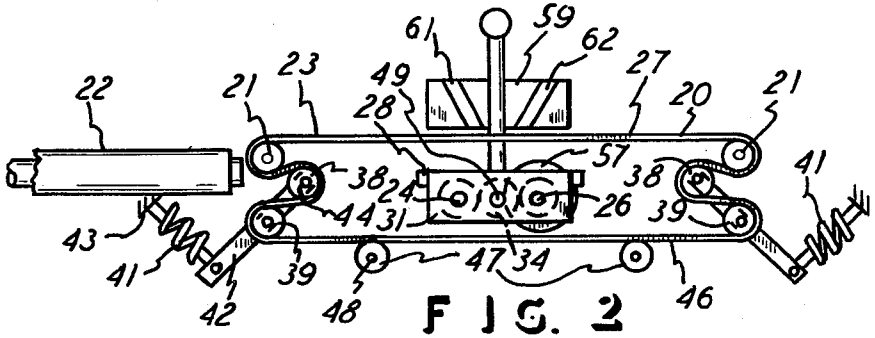
FIG. 2 is a side elevational view of a fragment of FIG. 1, with parts added thereto, and is a sectional view taken along the line 2—2 of FIG. 1.

Next, the present invention will be described, and the description is basically of the mechanical aspects, however in that description, the method invention will also be described since it is part of this invention. As such, the first conveyor is designated 16, and it consists of four belts 17, 18, 19, and 20, which are independently and separately supported, such as on the respective shafts 21, which are suitably rotatably mounted. Of course in operation, the four separate belts 17, 18, 19, and 20 have their upper surfaces moving in the direction of the arrow designated C, and thus they have the sheet 10 resting thereon and therefore convey the sheet in the direction of the arrow designated A as mentioned. The first conveyor 16, that is the four belts disclosed, are suitably power driven and deposit each sheet or signature 10 onto the second belt or conveyor 12, and that action would be in the nature of the so-called bump turn mode. FIG. 2 shows that the upper surface 22 of the conveyor 12 is at an elevation lower than the upper surface 23 of the first conveyor 16, and thus the sheet 10 will be adequately deposited onto the second conveyor 12.

This particular invention provides for separate movement of each of the plurality belts or driven members 17, 18, 19, and 20 of the first conveyor 16, and it also provides for separate driving members selectively positionable in driving relation with each of the aforementioned separately movable conveyor members or belts.

To accomplish the optional or selective drive of the plurality of belts mentioned, two separately rotatably mounted shafts 24 and 26 are disposed beneath the upper extent 27 of the first conveyor 16. The two shafts 24 and 26 are suitably rotatably supported in a pivotal frame or cage 28, which has end plates 29 and 31 and interconnecting side struts 32, all to form one rigid rectangularly shaped frame, as viewed in FIG. 1. Further, the shafts 24 and 26 are power driven by means of a motor 33 driving a gear 34 through a gear reducer 36 drivingly connected with the motor 33 and the gear 34. Each shaft 24 and 26 has a driven gear 37 in mesh with the driving gear 34 , and thus the shafts 24 and 26 are both rotated in the same direction and that is the counter clockwise direction, as viewed in FIG. 2. Therefore, as will be apparent later, the upper extent 27 of the first conveyor 16 will operate in the direction of the arrow C, as mentioned.

FIG. 2 further shows that the shafts or rotatable supports 21 can be in an axially fixed position, and likewise additional shafts or rotatable supports 38 are provided for each of the four belts mentioned and are on axially fixed positions and are rotatable to serve in the nature of idler pulleys or shafts for the respective four belts mentioned.

Finally, there are additional rotatably mounted shafts or pulleys 39 on which the individual four belts are also trained, just as the belts are trained on the pulleys or shafts 21. However, the pulleys or shafts 39 are not on a fixed axis but instead are movable under the influence of a tension spring 41, which is suitably connected to an arm 42, on which the shafts or pulleys 39 are rotatably mounted.

It will be seen and understood that the tension springs 41 exist on each end of the first conveyor 16, as shown in FIG. 2, and the springs are anchored at the fixed locations designated 43, and the other ends of the springs 41 are suitably connected to the pivotal arms 42, which pivot about the fixed pivot pins 44 on the axis of the rotatable members 38, in a conventional arrangement suitable for providing separate and individual tension in each of the four belts mentioned. That is, each belt 17, 18, 19 and 20 has a spring 41 connected therewith through the four pivot arms 42 which would exist beneath each of the eight pulleys or shafts 21, and thus each of the four belts is subjected to individual tension since each has two springs 41 connected therewith.

The lower extent 46 of each of the four belts is guided over two spaced apart rollers or pulleys 47, which are rotatably mounted on fixed axes designated 48. With the arrangement mentioned, the pulleys 39 are displacable relative to their respective axes, and thus the tension in each of the four belts is induced and maintained by the springs 41, all in a manner described hereinafter.

The described frame support for the shafts 24 and 26 is pivotal about the axis designated 49, and that is the axis of the driving gear 34. A pivot control arm 51 is suitable connected to the plate 29 of the shaft frame described, and the entire frame is thus pivotal by manipulation of the handle 51 and, by that arrangement, either shaft 24 and 26 will be displaced downwardly toward the belt lower reach 46. The shaft 24 has four driven pulleys 52 mounted thereon for rotation with the shaft 24, and a respective one of each of the pulleys 52 is aligned with each of the four belts; as shown in FIG. 1. Therefore, when the handle 51 is moved toward the left, as viewed in FIG. 2, the frame for the shafts 24 and 26 is pivoted counter clockwise and that positions the driving pulleys or members 52 into driving relation with the respective four belts at their lower reaches 46. The four driving members or pulleys 52 are of the same effective diameters so that the four belts 17, 18, 19 and 20 would all be driven at the same speed in the direction of the arrow C when the handle 51 is moved to the left, as viewed in FIG. 2. In that mode, the method and apparatus are arranged for the bump turn known to anyone skilled in the art and as described herein. Handle 51 is rotatable in mounting 50.

An alternative mode for the method and apparatus is accomplished by moving the handle 51 to the right, as viewed in FIG. 2, and thus move the shaft 26 downwardly against the belt reaches 46, and thereby disconnect the drive through the shaft 24 and instead connect the drive to the first conveyor 16 through the shaft 26. It will be seen in FIG. 1 the shaft 26 has four pulleys 53, 54, 56, and 57 drivingly mounted on the shaft 26 in spaced apart positions and in alignment with each of the respective four belts for driving each of the four belts at different speeds. Therefore, lowering the shaft 26 into its driving relation by moving the handle 51 to the right will position each of the four driving members on the shaft 26 into respective driving relationship with each of the four belts mentioned. However, as mentioned, each of the four belts will move at a speed different from each other, and, in the arrangement shown, the belts will move in progressively faster speeds with respect to the slower speed of the belt 17 and the fastest speed of the belt 20.

Figure 3:
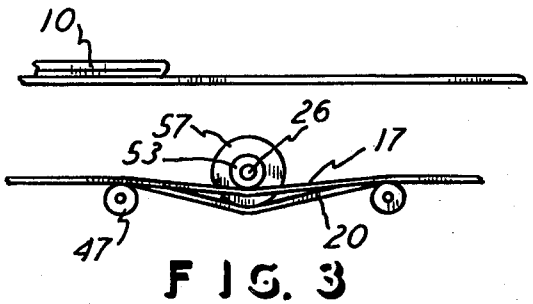
FIG. 3 is a side elevational view of a fragment of FIG. 2, with parts in a different position, and is a sectional view taken along the line 3—3 of FIG. 1.

FIG. 3 shows the mode just described, namely the driving relation through the shaft 26, and it will here be seen that the largest pulley 57 is in driving relation with its belt 20, and the smallest pulley 53 is also is driving relation with its belt 17, all for driving the belts 17 through 20 at the progressively increasing surface speeds mentioned. In that mode, any incoming signature or sheet 10 will thus be turned ninety degrees on the first conveyor 16, all so that the original leading sheet edge 13 is no longer in the leading position, but instead the side edge 58 becomes the leading edge and is presented to the stop 11. In that mode, this is the so-called flow turn which is normally accomplished by separate and elaborate prior art apparatus generating a ninety degree arc in the movement of the incoming sheet. With the present method and apparatus of this invention, the sheet leading edge 13 on the first conveyor 16 is also the leading edge on the second conveyor 12.

A detent plate 59 is indicated mounted adjacent the handle 51 for retaining the handle in the designated position of bump turn 61 or flow turn 62, and of course in either mode, the springs 41 permit the individual four belts to be under the spring tension as necessary for the individual and independent driving of the four belts at either the same speed, when the shaft 24 is the driving shaft, or at the progressively increasing speed, when the shaft 26 is the driving shaft.

In summary, with this method and apparatus invention, the operator has the option of effecting either the bump turn or the flow turn for the sheet or signature 10. With regard to the apparatus itself, only the apparatus as shown is required in order to accomplish either mode of operation, and two complete and separate sets of apparatus are not required, as required by the prior art according to whichever mode of operation is desired. Of course in the flowturn mode, the belt 16 is closest to the inside of the turning action for the sheet 10, and thus that belt is moving at the lowest speed compared to the other three belts, which are moving progressively faster for giving the ninety degree clockwise turn to the sheet 10, as viewed from above as in FIG. 1. In both modes described herein, the sheet 10 is moved in the direction of the arrow A and is then moved in the direction of the arrow B, and those two movements designate the path of the sheet 10 and of course are at right angles to each other. Further, in the bump flow mode, the sheet 10 remains in its original orientation on the first conveyor 16, however, in the flow turn mode, the sheet 10 is in a rotated orientation on the conveyor 16, all for presenting the original side edge 58 in the leading edge position.

What is claimed is:

1. Apparatus for conveying a sheet in a turning action, comprising a set of movably mounted belts extending in one direction and parallel to each other, a driving member disposed adjacent said belts, two shafts rotatably and displaceably disposed in driven rotatable relation to said driving member and extending adjacent said belts and transverse to the direction of the extent of said belts, a set of driving pulleys on each of said shafts for rotation therewith and with one pulley of each of said set being aligned with a respective one of each of said belts, all of said pulleys in said set on one of said shafts being of the same diameter, for driving all of said belts at the same speed when in contact with said belts when said one shaft is displaced into driving relation with said belts, and all of said pulleys in said set on the other of said shafts being of diameters different from each other, for driving all of said belts at speeds different from each other when in contact with said belts when said other shaft is displaced into driving relation with said belts.

2. The apparatus for conveying a sheet in a turning action, as claimed in claim 1, including a control connected with said shafts for displacing said shafts and thereby selective position said shafts into driving relation with said belts.

3. An apparatus for conveying a sheet in a turning action to alter its path of movement, comprising a first conveyor for movably supporting a sheet, a second conveyor in sheet-flow communication with said first conveyor for receiving the sheet from said first conveyor and moving the sheet at a right angle to the path of movement of the sheet on said first conveyor, said first conveyor including individually driven belts in supporting contact with the sheet, said driven belts being mounted to be capable of speeds of movement different from each other, two separate and movably mounted shafts mounted adjacent said belts and extending in the direction transverse to the length of said belts, a separate set of pulleys on each of said shafts and with each of said pulleys being respectively aligned with respective ones of said belts, said shafts being displacable relative to said driven belts for selectively positioning said pulleys into individual driving relationship with respective ones of said driven belts for driving said driven belts at individually different selective speeds of movement, one of said sets of said pulleys on one of said shafts being all of the same diameter, for driving all said belts at the same speed, and the other of said set of said pulleys on the other of said shafts all being of diameters different from each other and progressively larger from one end of said other shaft, for driving all said belts at different speeds and thereby rotating the sheet from its initial orientation on said first conveyor.

* * * * *